United States Patent [19]

Mulé et al.

[11] Patent Number: 4,958,760

[45] Date of Patent: Sep. 25, 1990

[54] MULTI-PURPOSE CARRIER FOR SKIS AND THE LIKE

[76] Inventors: Ethel Mulé; Charles Mulé, both of 5407 Windermere Court, Burlington, Ontario, Canada, L7L 3M8

[21] Appl. No.: 363,995

[22] Filed: Jun. 9, 1989

[51] Int. Cl.[5] ..... A45F 4/02

[52] U.S. Cl. ..... 224/153; 224/209; 224/42.01; 224/314; 224/318; 224/917

[58] Field of Search ..... 224/917, 151, 153, 209, 224/214, 246, 250, 251, 42.01, 314, 318, 319, 320, 328

[56] References Cited

U.S. PATENT DOCUMENTS

| | | | |
|---|---|---|---|
| 4,131,289 | 12/1978 | Maller | 224/917 |
| 4,358,137 | 11/1982 | Gramm | 224/917 |
| 4,518,107 | 5/1985 | Amos | 224/215 |
| 4,655,343 | 4/1987 | Lane et al. | 224/153 |
| 4,674,787 | 6/1987 | De Vera | 224/917 |
| 4,746,159 | 5/1988 | Webb et al. | 224/917 |

FOREIGN PATENT DOCUMENTS

| | | | |
|---|---|---|---|
| 2490597 | 3/1982 | France | 224/917 |
| 176777 | 7/1935 | Switzerland | 224/209 |

*Primary Examiner*—Linda J. Sholl

*Attorney, Agent, or Firm*—David J. French

[57] ABSTRACT

A multi-purpose carrier for skis and the like is comprised of a combination ski-boot and ski-protection bag that can be converted to a back-pack. This convenient unit, designated as a "Mule Pack" is adapted to be strapped to the roof rack of a car using the same straps that support the back-pack.

8 Claims, 5 Drawing Sheets

MULTI-PURPOSE CARRIER FOR SKIS AND THE LIKE

FIELD OF THE INVENTION

This invention relates to a collapsible container or bag for carrying articles of extended length which, as an example, would include skis, ski-poles etc. More particularly, this invention relates to an attachment means by which a carrier may alternately be fastened to a rack on a vehicle or carried as a back-pack. Additional features render this carrier particularly suitable for ski-related applications.

BACKGROUND TO THE INVENTION

It is on occasion desirable to have a flexible carrying pack that is adapted both to be fastened to a vehicle and to be carried as a pack on the back of an individual. This is particularly true in the case of carriers for ski equipment.

In the case of ski equipment, it is desirable to have a container which will protect skis from the elements, and particularly road salt, when the skis are mounted on a roof-top car rack. It is also desirable to provide a convenient means by which all of the paraphernalia needed for skiing can be conveniently carried from the car to the ski slopes. This paraphernalia includes the skis, ski poles, ski boots, ski wax, ski glasses or goggles and occasionally, food and other refreshments.

Once a skier has donned his skiing outfit it would be convenient to have a portable pack to carry extra clothing, food and refreshments, and other items.

This invention relates to a carrier which is adapted to carryout all of these functions.

It has been proposed in the past to form a back-mounted ski and ski pole carrier of a pliant fabric that can be collapsed into a pouch and carried by means of a waist-belt, once the skis are removed. U.S. Pat. No. 4,518,107 to Jacquelyn Amo is exemplary of such a concept. Other references that have addressed the need to provide combination protective means and carrying facilities for skis include U.S. Pat. Nos. 4,674,787 to Freddie DeVera and 4,358,137 to Raymond Gramm.

While such prior concepts have addressed the problem of permitting ski equipment to be carried by individuals in a protecting covering, no consideration has been given to providing such carriers with a means by which the protected skis may be attached to a rack or carrier on the roof of a vehicle.

Car top carrier racks customarily are based on two transverse bars that are mounted on the roof or trunk of the vehicle. These transverse bars are generally spaced apart by a distance of two to three feet. They may be equipped with fastening means for retaining skis, or may relay on separate lashings to provide a firm attachment of the skis to the racks. This invention is directed to providing a special means by which the attachment means of the ski equipment carrier is adaptable both for carrying by an individual, as a back-pack, and for attachment to a vehicle rack.

Another feature of this invention is the manner in which it provides for the conversion of the carrier from a container for skis into a back-pack.

These and further features of the invention will be more apparent from the summary and further description which follows.

SUMMARY OF THE INVENTION

According to the invention, a bag for protecting an article, of extended length, such as a pair of skis, is provided with two straps, each anchored at one of their respective ends, to a generally rectangular panel portion of the bag at opposite sides of such panel and at positions diaganolly displaced from each other. Two connector means for coupling the free ends of the straps to the bag are attached to the panel portion of the bag respectively on opposed sides of the bag, opposite the attachment points where the straps are respectively anchored to the panel portion of the bag. The straps are of such length that they may alternately be coupled to the connector on the same or opposite sides of the bag.

Where the bag is adapted to contain skis, the panel portion is preferably generally centrally located on the bag with the ski-containing portions of the bag extending on either side of the panel portion. A handle mounted on this central panel will then allow the skis to be carried in a balanced manner.

For carriage of the container as a back-pack the ski-containing portions outside the central panel may be folded for storage in an accordion-like fashion to rest in a flat and layered manner against the central panel of the bag. Fastening means are provided to retain the bag in such "nested" state. With the ski-containing portions so stored, the straps may now be connected to produce a shoulder-harness arrangement.

By reason of the diagnolly displaced manner by which the straps are attached to the panel portion an article carrier is provided that may alternately be fastened to two transverse bars of an automobile carrying rack, or converted to a pack-sack with shoulder straps. In the former case, the straps may be passed around the bars of the car rack with their free ends attached to their respective connectors on the opposite side of the bag. Because the straps are anchored to the bag at diagonally displaced locations, each strap will be positioned proximate to one of the roof rack bars. When used as a back-pack, the strap ends may be fastened to the connectors located on the same respective sides of the bag as the straps are anchored, creating a form of shoulder harness.

The face of the panel portion wherein the straps are anchored may be provided with a separate auxiliary compartment (for ski boots and other items) that is attached to the principal bag. Optionally, this auxiliary compartment may be detachably attached to the principal bag. Further, this auxiliary compartment may be subcompartmentalized to provide a means for carrying further items, such as ski wax, in a separated chamber.

These and further features of the invention will be apparent from the description of the preferred embodiments which now follow.

DESCRIPTION OF THE PREFERRED EMBODIMENT

Figure 1:
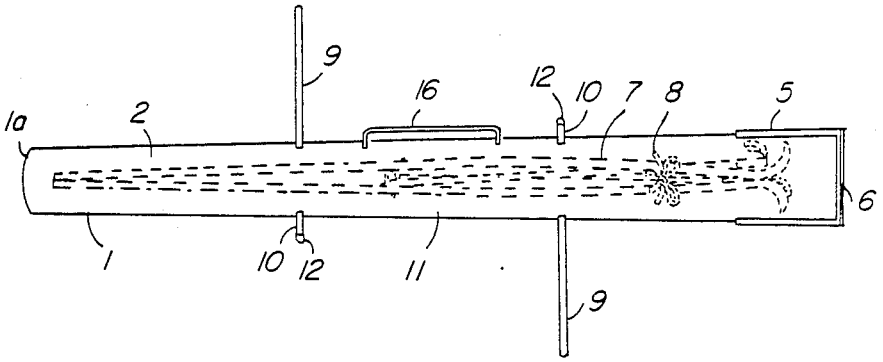
FIG. 1 is a top view of a bag according to this invention.

In FIG. 1 the layout of the basic bag 1 is depicted. The bag has upper and lower panels 2, 3 (shown in FIG. 3) that are joined together by edge portions 4 that may be extensions to the upper or lower panel portions.

At one end of the bag 1 is an access opening 5 that is closable by a zipper 6, or equivalent. This access opening 5 allows skis and ski poles 7 to be inserted in the bag 1. Tether straps 8 inside the bag 1 may be used to retain the skis and poles 7 better within the bag 1. The foot 1*a* of the bag 1 may be reinforced with a double layer of fabric, or equivalent, to resist wear when the bag 1 with skiis 7 inside is stood on its end.

Attached along the sides of the upper panel 2 of the bag 1 are a pair of straps 9 and connectors 10. The straps 9 are each anchored at one of their ends to the bag 1 at diagonally opposite positions on the generally central panel portion 11 of the bag 1. The straps 9 and connectors 10 may be attached by rivets, stitching, or other appropriate means to this central panel 11. The connectors 10 may be composed of straps with buckles 12 or other attachment means at the free end.

Figure 2:
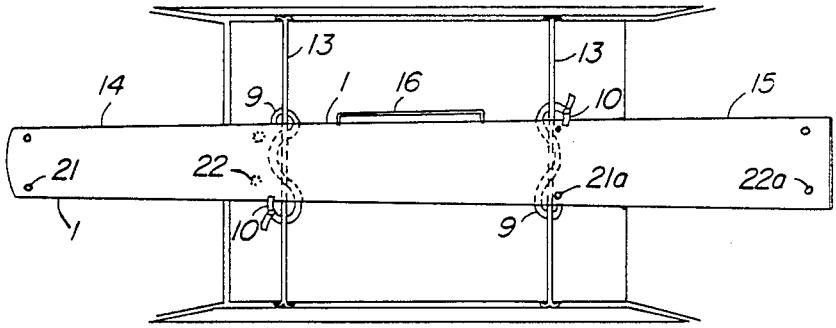
FIG. 2 is the bag of FIG. 1 fastened to a car top roof rack.

The diagonal placement of the straps 9 and connectors 10 allows the bag to be conveniently attached to a car-top carrier rack. This is shown in FIG. 2 where two transverse bars 13 of a car carrier rack are shown with the bag 1 laid over them, aligning the bag 1 longitudinally with the car (not shown).

When mounted on such carrier bars 13, the straps 9 may be wrapped around the bars 13 and then attached to the connectors 10. By reason of the diagonal placement of the straps 9 and connectors 10, the bag 1 is easily fastened to the carrier bars 13 with the outward portions 14, 15 of the bag 1 extending parallel to the longitudinal directional of the car.

Once the vehicle arrives at the site where skiiing is to occur, the bag 1 may be removed from the carrier bars 13 and then carried to the slopes by the handle 16. Upon removal of the skis, the bag 1 may be folded in the manner depicted in FIGS. 3 and 4. For clarity in the drawings the flattened bag is shown as having substantial thickness. In fact, the fabric of the bags will flatten to a minimal thickness.

Figure 3:
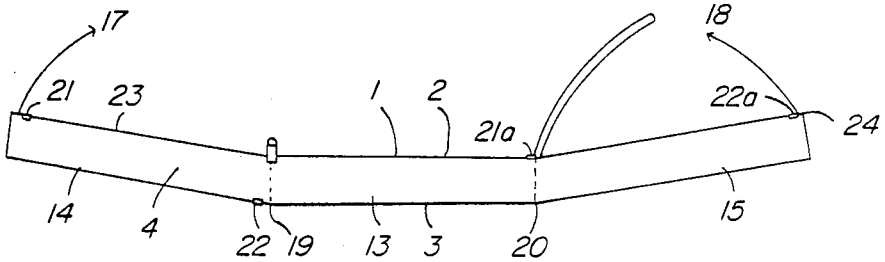
FIG. 3 is an edge view of the bag of FIG. 1.

The bag 1, shown in side view in FIG. 3, is converted for attachment to an individual's back by folding it in the direction of the arrows 17, 18. The outer panel portions 14, 15 are flattened and folded the fold lines 19, 20 so as to overlay the central panel 13 with the outer portions 14, 15 in an interleaved format. As a guide to folding, transverse fabric of a different colour may be fastened to the upper 2 and lower 3 surface of the bag 1 at the fold lines 19, 20 to assist the user in folding the bag 1 at the correct place.

Fasteners 21, 21*a* and 22, 22*a* are provided in pairs to retain the three panels 11, 14, 15 in alignment once interleaved. These fasteners 21, 21*a*, 22, 22*a* may be typical metallic snap-fasteners of the male-female type, VELCRO TM -type attachment means or equivalent. For such fastener portions are shown in FIG. 3 adjacent to the front side edge 23 of the bag 1. A further four fasteners would also be symmetrically deployed adjacent to the rear side edge 24 to ensure that the end portions 14, 15 are secured on both sides.

Figure 6:
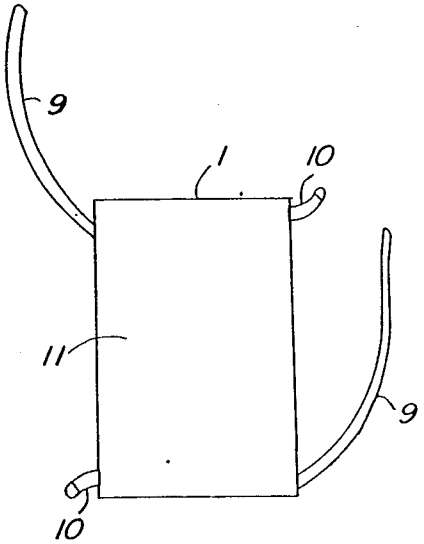
FIG. 6 is a face view of the bag, when folded, showing the location of the straps and connectors.
Figure 5:
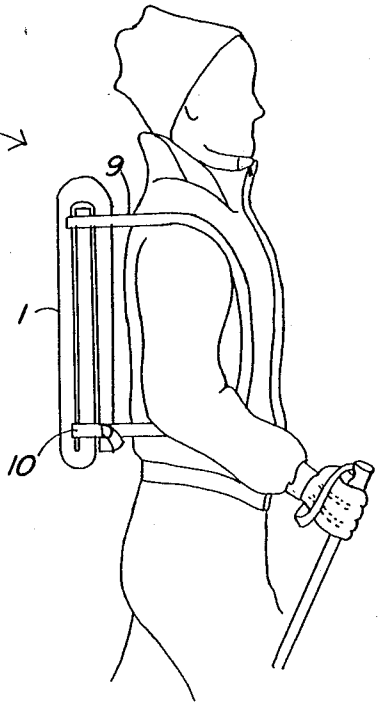
FIG. 5 is a view showing the bag of FIG. 4 being carried by an individual.
Figure 4:
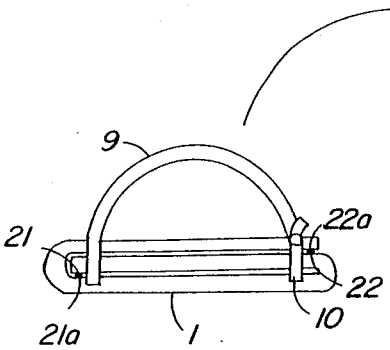
FIG. 4 is an edge view of the bag when folded in nested fashion to create a back pack.

The bag 1 is shown in its folded state in FIGS. 4, 5 and 6. Again, the thickness of the folded bag is exaggerated for clarity. In FIG. 4 the fasteners 21, 21*a* and 22, 22*a* are shown engaged and the strap 9 is shown attached to the connector 10. In this arrangement a back-pack with shoulder straps is created, suitable for being carried, as shown in FIG. 5.

The straps 9 of the folded bag 10 may be seen in their diagonally anchored arrangement in FIG. 6. Because the connectors 10 are also diagonally mounted in a complementary fashion, the straps 9 when joined to the connectors 10, will be positioned in the normal arrangement for a back-pack.

Figure 7:
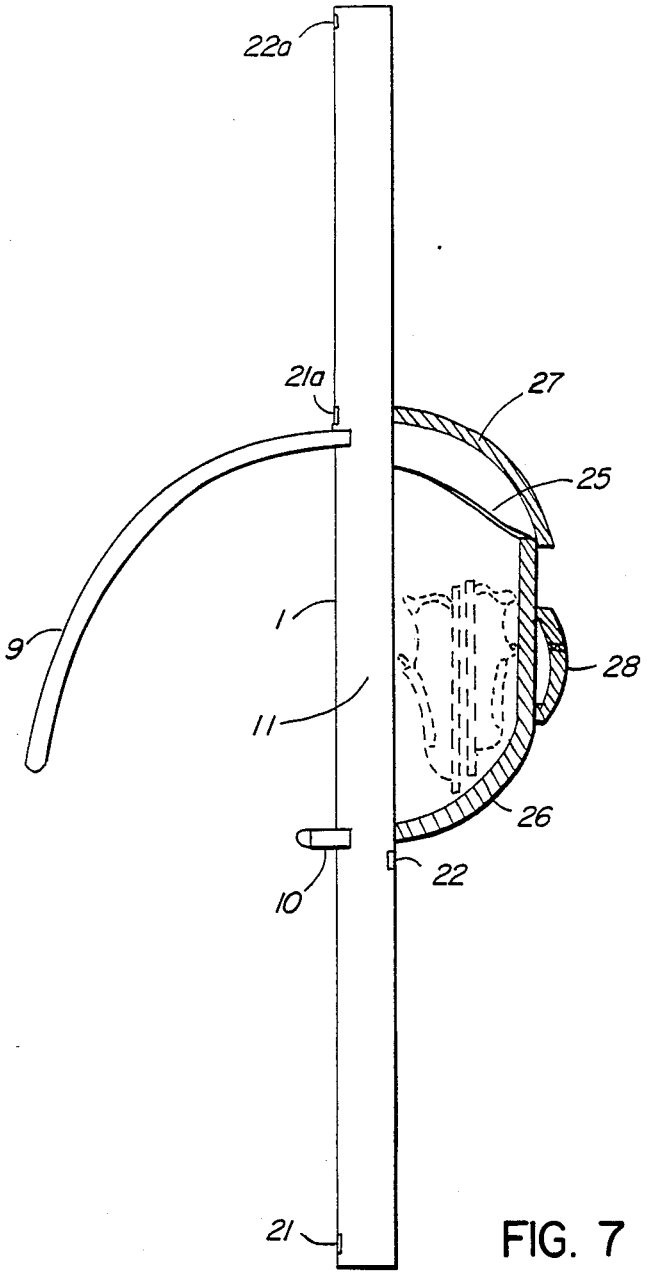
FIG. 7 is an edge view of the bag with a cut away view of an accessory bag attached thereto.
Figures 8, 9, 9A:
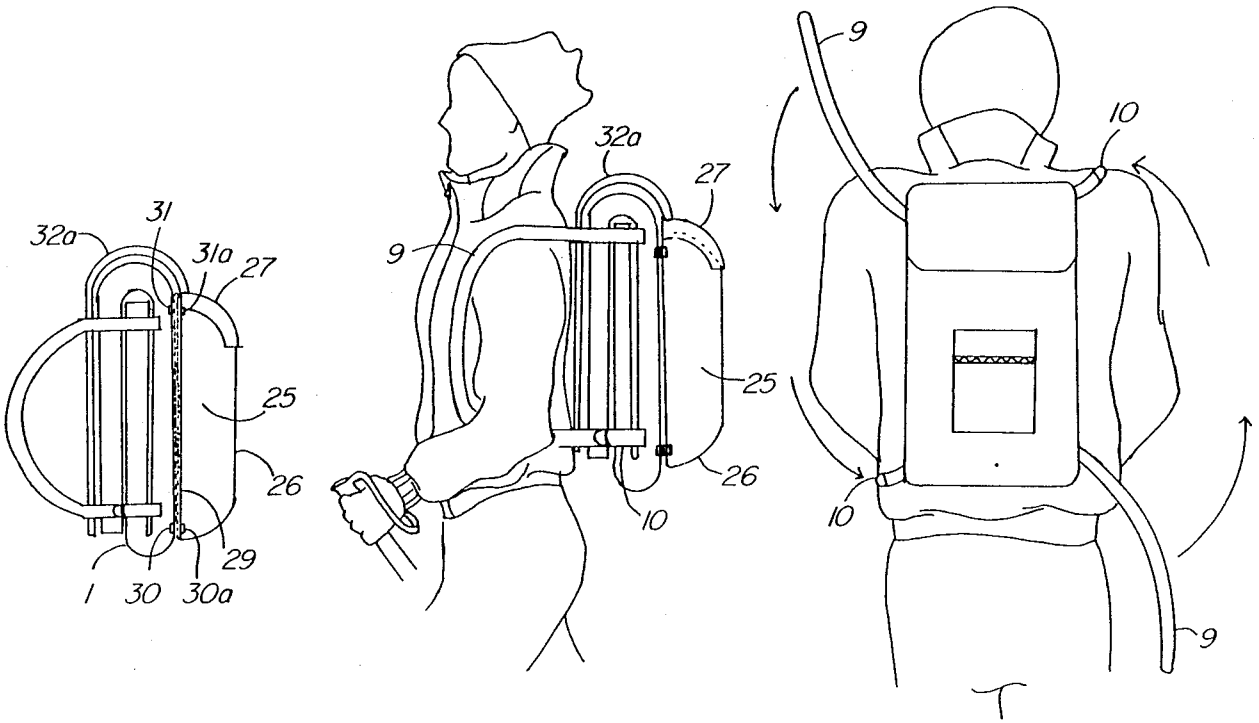
FIG. 8 is a depiction of a bag with detachable accessory bag, in folded format, and with a dirt-guard panel.
FIG. 9 is a side view of an individual carrying a bag with accessory bag.

Throughout the description so far, the bag 1 has been shown as designed simply to carry skis. The back-pack format for the bag 1 can be of considerably greater utility if an accessories bag 25 is add thereto. Such an accessories bag 25 is shown in FIGS. 7, 8 and 9. In FIG. 7, the accessories bag 25 is shown in cross-section, attached to the main bag 1, which is not shown in cross-section. The accessory bag 25 may be formed by attaching a lower portion 26 and upper flap portion 27 to the lower or outer panel 3 of the bag 1 in the central panel portion 11 of the bag 1. A zipper-accessed utility compartment may be formed on the outside of the bag 25 to provide a pouch for small articles, such as ski wax.

Figure 10:
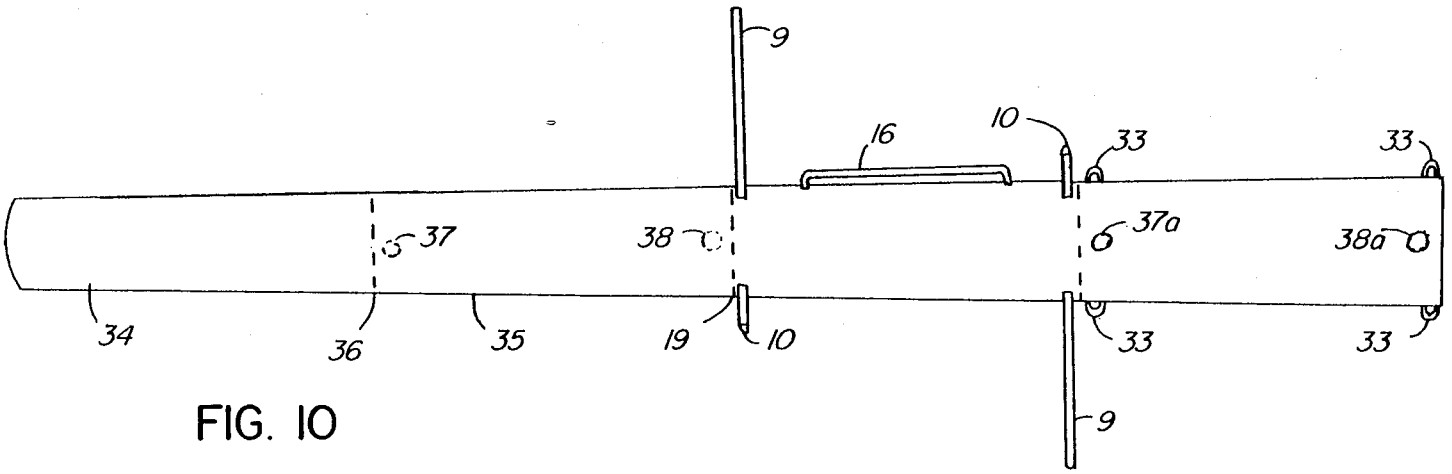
FIG. 10 is a top view of a bag of extended length with retention loops.

The lower accessory bag portion 28 and flap 27 may be fastened directly by sewing to the outer panel 3, as shown in FIG. 9, or may be formed with their own back panel 29, as shown in FIG. 10. In the latter case fasteners 30, 30*a*, 31, 31*a* of the type mentioned earlier may be used to attach the accessory bag 25 to the basic bag 1.

One advantage of utilizing an accessory bag 25 with a back panel 29 is that a flap 32 may be stored between the accessory bag 25 and the folded carrier bag 1. This is shown in dotted outline in FIG. 8. This flap so stored will be protected from the elements when the carrier is on a car top. It will then be clean and available to be deployed as a protective cover 32*a* to keep dirt on the bag 1 from being transferred to a wearer.

Figure 11:
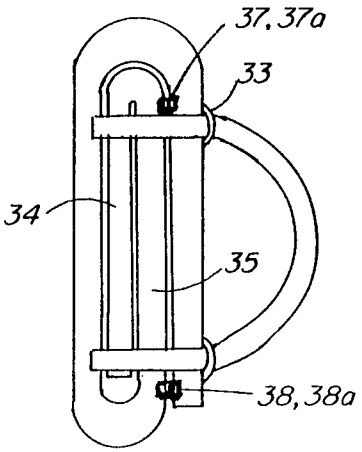
FIG. 11 is a side view of the bag of FIG. 10 in folded format.

In order to improve the coherent assembly of the bag 1 when folded, loops 33 may be attached to the outermost panel as seen when folded. This is shown in FIGS. 10 and 11. The straps 9 may be passed through the loops 33 to add further security to the packed array of nested bag portions.

The drawings prior to FIGS. 10 and 11 show a bag 1 with three folded panel portions. To contain longer skiis, the bag may be provided with four folded panel portions as in FIGS. 10 and 11.

In this case, the handle 16 may be displaced to a near balancing location on the bag. Otherwise, the straps 9 and connectors 10 function in the same manner.

When folded, as in FIG. 11, the extra portions 34, 35 of the bag may be doubly folded along fold lines 19 and 36. Fasteners 37, 37*a*, 38, and 38*a* may be provided to hold these portions 34, 35 in position when the bag 1 is folded.

From the foregoing description it will be seen how a carrier bag for elongated articles may be provided which is adaptable both as a roof-top carrier and as a back pack.

The foregoing description is made in respect of preferred embodiments of the invention. The invention in its broadest and more particular elements is further described and defined in the claims which now follow.

The embodiments of the invention in which an exclusive privilege is claimed are as follows:

1. A carrier bag adapted to carry longitudinally extending articles on a parallel bar roof rack and convertible to the formate of a back-pack comprising:

(a) a bag of foldable fabric material having upper and lower longitudinally extending face portions, with a centrally located central panel portion, and edge portions joining said face portions, said edge portion being openable at one end to permit insertion of articles such as skiis;

(b) a pair of straps of extended length, each attached at one of their respective attachement ends to opposite sides of said central panel portion of said bag proximate said edge portions, said attachment positions being diagonally displaced from each other accross said central panel portion;

(c) a pair of complementary connector means attache to opposite sides of said central panel, said connector means being proximately located to said central panel and being adapted to releasably connect to said straps, said connector means further being diagonally spaced from each other across said central panel portion and attached to said central panel portion at points opposite the attachment positions of said straps; and (d) fastener means on said face portions adapted to hold the outer portions of said bag on either side of said central panel in position when folded in nested fashion to rest against said central panel, whereby said carrier bag may be alternatively attached to a parallel bar roof rack by joining said straps to the complementary connector means located directly opposite to the attachment ends of said straps, and may be converted to the format of a back-pack by joining said straps to the respective complementary connector means located on the same side of said central panel portion as the attachment positions of each respective strap.

2. A bag in claim 1 having fastened to the exterior face portion at said central portion a further bag compartment adapted for carrying accessories.

3. A bag as in claim 1 having a carrying handle attached to said central bag portion.

4. A bag as in claim 3 having a carrying handle attached to said central bag portion.

5. A bag as in claim 1 having tether means within said bag's interior for immobilizing articles stored therein.

6. A bag as in claim 5 having tether means within said bag's interior for immobilizing articles stored therein.

7. A bag as in claim 1 having loops on said panel portions through which said straps may pass when the bag is folded in a nested fashion.

8. A bag as in claim 7 having loops on said panel portions through which said straps may pass when the bag is folded in a nested fashion.

* * * * *